US007441877B2

(12) United States Patent
Kubo et al.

(10) Patent No.: US 7,441,877 B2
(45) Date of Patent: Oct. 28, 2008

(54) SUBSTRATE HAVING A PLURALITY OF COMMON POWER SUPPLY WIRES AND A PLURALITY OF COMMON GROUND WIRES FOR INKJET RECORDING HEAD AND INKJET RECORDING HEAD USING THE SAME

(75) Inventors: Kousuke Kubo, Yokohama (JP); Yoshiyuki Imanaka, Kawasaki (JP); Takuya Hatsui, Setagaya-ku (JP); Souta Takeuchi, Yokohama (JP); Takaaki Yamaguchi, Yokohama (JP); Takahiro Matsui, Koganei (JP)

(73) Assignee: Canon Kabushiki Kaisha, Tokyo (JP)

( * ) Notice: Subject to any disclaimer, the term of this patent is extended or adjusted under 35 U.S.C. 154(b) by 394 days.

(21) Appl. No.: 11/299,796

(22) Filed: Dec. 13, 2005

(65) Prior Publication Data

US 2006/0125881 A1 Jun. 15, 2006

(30) Foreign Application Priority Data

Dec. 15, 2004 (JP) ..... 2004-363594

(51) Int. Cl.
*B41J 2/05* (2006.01)

(52) U.S. Cl. ..... 347/58; 347/59

(58) Field of Classification Search ..... 347/5, 347/9, 56–59, 61–65, 67
See application file for complete search history.

(56) References Cited

U.S. PATENT DOCUMENTS

| | | | | |
|---|---|---|---|---|
| 5,943,070 | A | 8/1999 | Kamiyama et al. | 347/19 |
| 6,257,695 | B1 | 7/2001 | Kamiyama et al. | 347/19 |
| 6,357,862 | B1 | 3/2002 | Ozaki et al. | 347/58 |
| 6,409,315 | B2 | 6/2002 | Komuro | 347/58 |
| 6,471,339 | B1 | 10/2002 | Kamiyama et al. | 347/61 |
| 6,474,788 | B1 | 11/2002 | Saito et al. | 347/58 |
| 6,474,790 | B2 * | 11/2002 | Kaneko | 347/59 |
| 6,945,629 | B2 | 9/2005 | Yamaguchi et al. | 347/48 |
| 6,948,789 | B2 | 9/2005 | Imanaka et al. | 347/9 |
| 6,962,405 | B2 | 11/2005 | Imanaka et al. | 347/58 |
| 7,029,081 | B1 | 4/2006 | Imanaka et al. | 347/5 |
| 2005/0128254 | A1 | 6/2005 | Ibe et al. | 347/58 |
| 2005/0179745 | A1 | 8/2005 | Yamaguchi et al. | 347/67 |
| 2006/0077215 | A1 | 4/2006 | Imanaka et al. | 347/5 |
| 2006/0232633 | A1 | 10/2006 | Kubo et al. | 347/58 |

FOREIGN PATENT DOCUMENTS

| | | |
|---|---|---|
| JP | 1044416 A | 2/1998 |

* cited by examiner

*Primary Examiner*—Juanita D Stephens
(74) *Attorney, Agent, or Firm*—Fitzpatrick, Cella, Harper & Scinto

(57) ABSTRACT

Limitations on the number of recording elements capable of being simultaneously driven are relaxed so that driving voltage fluctuation falls within an allowable range. The substrate includes arrays of recording elements, common power supply wires extended from portions near one end portions of the arrays to portions near the other end portions thereof and connected to a power supply-side electrode pad through a position near the one end portions of the arrays, and common ground wires extended from portions near the one end portions of the arrays to portions near the other end portions thereof and connected to a ground-side electrode pad through a position near the other end portions of the arrays. Thus, since the sum of the lengths of common wires from the electrode pads is equal for all the plurality of elements included in each array, and the combined resistance of common wiring portions becomes substantially equal.

34 Claims, 11 Drawing Sheets

SUBSTRATE HAVING A PLURALITY OF COMMON POWER SUPPLY WIRES AND A PLURALITY OF COMMON GROUND WIRES FOR INKJET RECORDING HEAD AND INKJET RECORDING HEAD USING THE SAME

BACKGROUND OF THE INVENTION

1. Field of the Invention

The present invention relates to a substrate for an inkjet recording head which ejects ink onto a recording surface of a recording medium to perform recording operation, and to an inkjet recording head using the same. An inkjet recording head suitable for applying the present invention has a plurality of ink supply ports which are shaped like long grooves and which lead ink from the opposite surface (backside) of the substrate from the surface where elements for generating energy used to eject ink are arranged, through the substrate to the elements. Furthermore, the inkjet recording head is one which ejects ink in a direction perpendicular to the plane of the substrate in response to the driving of the elements.

2. Description of the Related Art

Inkjet recording heads applied to recording apparatuses which perform recording by imparting ink to recording media such as recording paper include ones which perform ink ejection by various methods. In one method, a heating portion (also called heater) made of a resistive element which generate heat in response to energization is used, and recording is performed by utilizing pressure generated by thermally foaming ink. In this type, a substrate for an inkjet head in which many heating portions, wirings, and the like are arranged at a high density can be manufactured easily and accurately. Accordingly, the finess and speed of recording can be improved. Further, this makes it possible to make more compact the inkjet recording head or a recording apparatus using this.

In one form of an inkjet recording head of the above-described type which utilizes thermal energy, ink is ejected in a direction perpendicular to a main surface of a substrate on which heating portions are arranged. In an inkjet recording head of this form, ink to be ejected is generally supplied from the opposite surface from the above-described main surface through an ink supply port which penetrates a substrate.

FIGS. 1 and 2 illustrate one known example of such an inkjet recording head (hereinafter also simply referred to as a recording head). FIG. 1 is a perspective view illustrating part of a substrate by cutting out part of a member forming ejection openings and the like. FIG. 2 is a plan view illustrating interconnections and the like arranged on a main surface of the substrate of the recording head.

In this type of recording head, as illustrated in FIG. 1, a plurality of heating portions 802 arranged in a staggered pattern on both sides of an ink supply port 803 penetrating the substrate are provided on the main surface of the substrate 805. And in addition, a member for forming ink passages 804 and a plurality of ink ejection openings 801 for ejecting ink which correspond to the plurality of heating portions 802 is placed on the substrate 805. On the substrate 805 illustrated in FIG. 2, in order to selectively drive the plurality of heating portions 802 in accordance with recording data to eject ink, the following wiring, circuit, or the like is provided:

Common power supply lines 902*a* and 902*b* connected to a power supply side The plurality of heating portions 802, heating portion wiring 910 for energizing each heating portion 802, and a driving circuit (hatched portion in the drawing which is formed in a layer lower than the heating portions and a related wiring layer) which includes driving elements such as transistors Ground (GND)-side common lines 904*a* and 904*b* Further, the common lines on the power supply side and the GND side can be electrically connected to the outside of the substrate through electrode pads 903. It should be noted that required interlayer insulating films placed in relation to layers for forming the heating portions, electrode wires, and the driving elements, a protective layer for protection against ink, and the like are not illustrated in the drawing.

In the inkjet recording head having the above-described configuration, ink is held in a state in which the ink forms a meniscus in the vicinity of each ejection opening 801. The heating portions 802 are selectively driven in accordance with recording data in this state, and the thermal energy generated is utilized to sharply heat and boil the ink on a heat applying surface. Thus, ink can be ejected by the pressure of bubbles generated at this time.

Incidentally, electric energy or power which is applied to the heating portions in order to eject ink is one of important factors which influence the ejection. That is, when the applied electric energy varies, a foaming phenomenon also varies accordingly, and favorable ejection may not be performed. For example, in the case where driving energy applied is small, an ink-boiling phenomenon is prone to become unstable because of an energy shortage. Then, favorable film boiling does not occur. This causes fluctuations in the ejection speed and ejection direction of ink and further causes fluctuations in the ejection amount. These may cause a deterioration in the quality of a recorded image. On the other hand, in the case where the applied driving energy is high, excessive thermal energy imposes mechanical stress on an electrothermal transducer or causes a change in film quality. These may also cause an ejection failure as described above. In extreme cases, the recording head may be broken. Accordingly, it is desirable that an appropriate, substantially constant amount of energy should be applied to each of the plurality of heating portions and that the energies applied to the plurality of heating portions should be substantially equal.

On the other hand, known factors that cause fluctuations in energy applied to each heating portion also include one caused by the fact that the number of heating portions simultaneously driven changes in one recording head. That is, if the number of heating portions simultaneously driven changes depending on recording data or the like, a voltage drop generated changes accordingly. As a result, the driving energy of each heating portion changes.

As one of countermeasures against this problem, heretofore, there has been a configuration disclosed in, for example, Japanese Patent Application Laid-open No. 10-44416 (1998). In this configuration, as illustrated in FIG. 2, each of common wirings between the heating portions 802 and electrode pads and that between the driving elements and the electrode pads is divided into a plurality of portions which correspond to groups of a certain number of heating portions and driving elements. Further, the wiring resistances of the common lines 902*a*, 902*b*, 904*a*, and 904*b* are approximately equal. This configuration makes it possible to reduce the difference in voltage drop between the case where all heating portions are driven and the case where one heating portion is driven for each group. Further, for each group, the difference in voltage drop between the case where all heating portions in the group are sequentially driven and the case where one heating portion is driven can be eliminated by performing time division driving in units of one heating portion and thus setting the number of heating portions simultaneously driven to one. This makes it possible to always apply constant driving energy to each heating portion.

This configuration is based on reducing voltage drops due to the fact that the length of common wiring for each heating portion differs depending on the position of the heating portion, particularly in the case where one common wiring is provided for all heating portions, among voltage drops caused when the heating portions are driven. Accordingly, in the configuration of Japanese Patent Application Laid-open No. 10-44416 (1998), common wiring widths are made as large as possible to reduce wiring resistances thereof. In addition, the wiring widths, such as widths A and B illustrated in FIG. 2, differ depending on the wiring length to each group. Thus, the wiring resistances are set to be equal.

However, in recent inkjet recording apparatuses, dominating recording heads are ones which have a plurality of ink supply ports in one substrate in order to obtain a high-resolution, high-quality image fast, and into which a plurality of heating portions are integrated at a high density in association with the ink supply ports. Accordingly, the numbers of power supply line terminals, GND line terminals, pulse signal input terminals, and data input terminals continue increasing. Thus, in the case of known connection by individual wiring in units of the certain number of heating portions, the size of a substrate is greatly increased because of the number of electrode pads, and cost is increased. On the other hand, there are demands for the downsizing of recent recording apparatuses. With the demands, recording heads and the like also tend to be downsized. Accordingly, in the case of known connection by individual wiring, it is very difficult to reduce the size of a substrate under the constraint that the size of a recording head cannot be easily increased as described above.

SUMMARY OF THE INVENTION

The present invention has been accomplished in order to solve the above-described known problems. An object of the present invention is to implement heating portions or ejection openings at a high density without causing an increase in the size of a recording head due to the number of electrode pads.

In an aspect of the present invention, there is provided a substrate for an inkjet recording head, comprising:

a plurality of arrays of recording elements;

a plurality of common power supply wires each of which extends from a position near one end portion of each the array to a position near the other end portion thereof and is connected to a power supply-side electrode pad through the position near the one end portion of the array; and a plurality of common ground wires each of which extends from a position near the one end portion of each array to a position near to the other end portion thereof and is connected to a ground-side electrode pad through the position near the other end portion of the array, wherein the plurality of common power supply wires and the plurality of common ground wires are collectively wired to the power supply-side electrode pad and the ground-side electrode pad, respectively.

In another aspect of the present invention, there is provided an inkjet recording head constructed using the substrate.

According to the present invention, the sum of the length of a common power supply line from a power supply-side electrode pad to each recording element and the length of a common ground line from the recording element to a ground-side electrode pad is substantially equal for a plurality of recording elements included in an array. Accordingly, since the combined resistance of common wiring portions can be made substantially equal, limitations on the number of recording elements capable of being simultaneously driven within a required allowable range of voltage fluctuation can be greatly relaxed. Furthermore, the number of electrode pads can therefore be reduced to a minimum. This makes it possible to implement heating portions or ejection openings at a high density without causing an increase in the size of a recording head due to the number of electrode pads.

The above and other objects, effects, features and advantages of the present invention will become more apparent from the following description of embodiments thereof taken in conjunction with the accompanying drawings.

DETAILED DESCRIPTION OF THE PREFERRED EMBODIMENTS

Hereinafter, the present invention will be described in detail with reference to drawings.

Figure 3B:
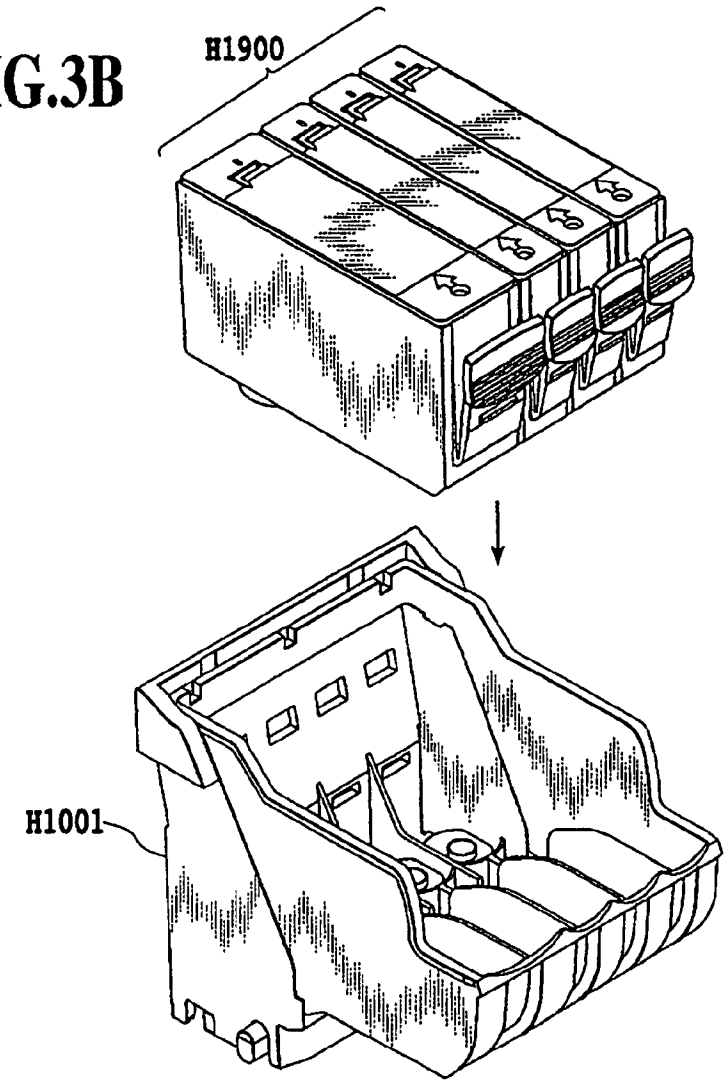
FIGS. 3A and 3B are perspective views illustrating a recording head cartridge to which a recording head according to one embodiment of the present invention can be applied.
Figure 3A:
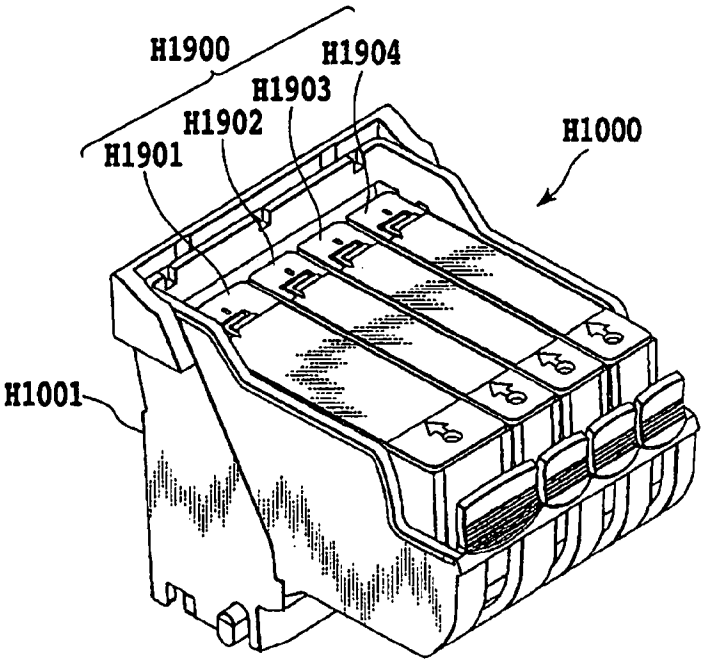

FIGS. 3A and 3B are perspective views illustrating a recording head cartridge H1000 to which a recording head H1001 according to one embodiment of the present invention can be applied. This recording head cartridge H1000 includes the recording head H1001 and ink tanks H1901, H1902, H1903, and H1904 which are provided to be attachable and detachable to/from the recording head H1001 as illustrated in FIG. 3B. It should be noted that these ink tanks are denoted by reference numeral H1900 in the case where they are not specified. These ink tanks may be ones corresponding to, for example, black, cyan, magenta, and yellow inks (recording liquid). The recording head H1001 ejects ink, which is supplied from the ink tanks H1900, from ejection openings in accordance with recording information.

This recording head cartridge H1000 is fixed and supported by positioning means and electrical contact points of a carriage (described later) which is mounted in a body of an inkjet recording apparatus, and can be attached and detached to/from the carriage. The recording head H1001 has a side-shooter recording head body which performs recording using resistive elements that generate thermal energy for causing the film boiling of ink in accordance with electric signals.

Figure 4:
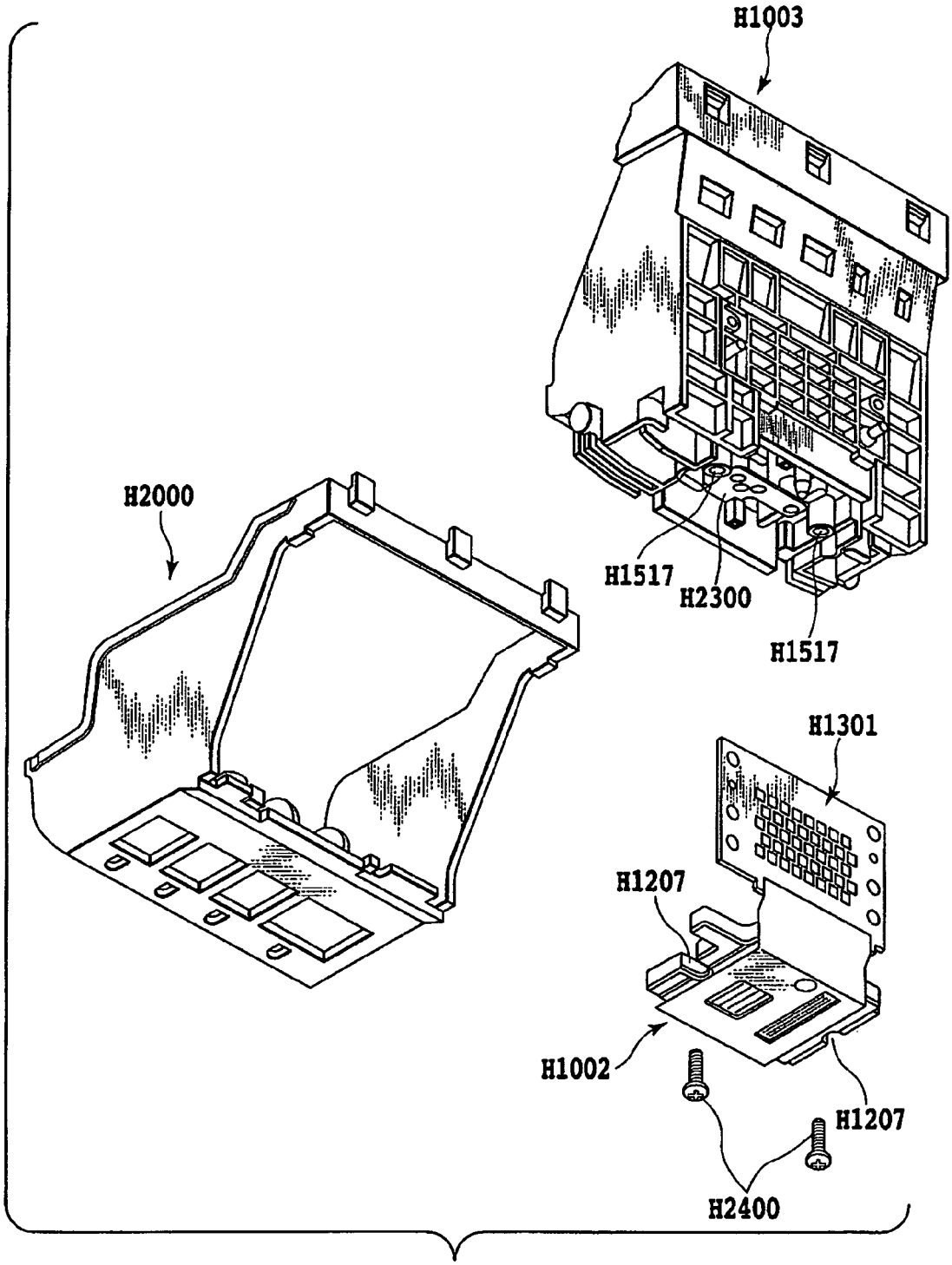
FIG. 4 is an exploded perspective view of the recording head of FIGS. 3A and 3B.

FIG. 4 is an exploded perspective view of the recording head H1001. As illustrated in this drawing, the recording head H1001 generally includes a recording element unit H1002, an ink supply unit (recording liquid supply means) H1003, and a tank holder H2000. In order to allow ink-communicating ports of the recording element unit H1002 and those of the ink supply unit H1003 to communicate with each other without causing leakage, a joint seal member H2300 which is attached to the peripheries of the respective communicating ports by pressure is inserted between the recording element unit H1002 and the ink supply unit H1003. Furthermore, the recording element unit H1002 is fixed to the ink supply unit H1003 by screwing screws H2400 into fastening boss portions H1517 of the ink supply unit H1003 through two screw fixation positions H1207 of the recording element unit H1002.

Figure 5:
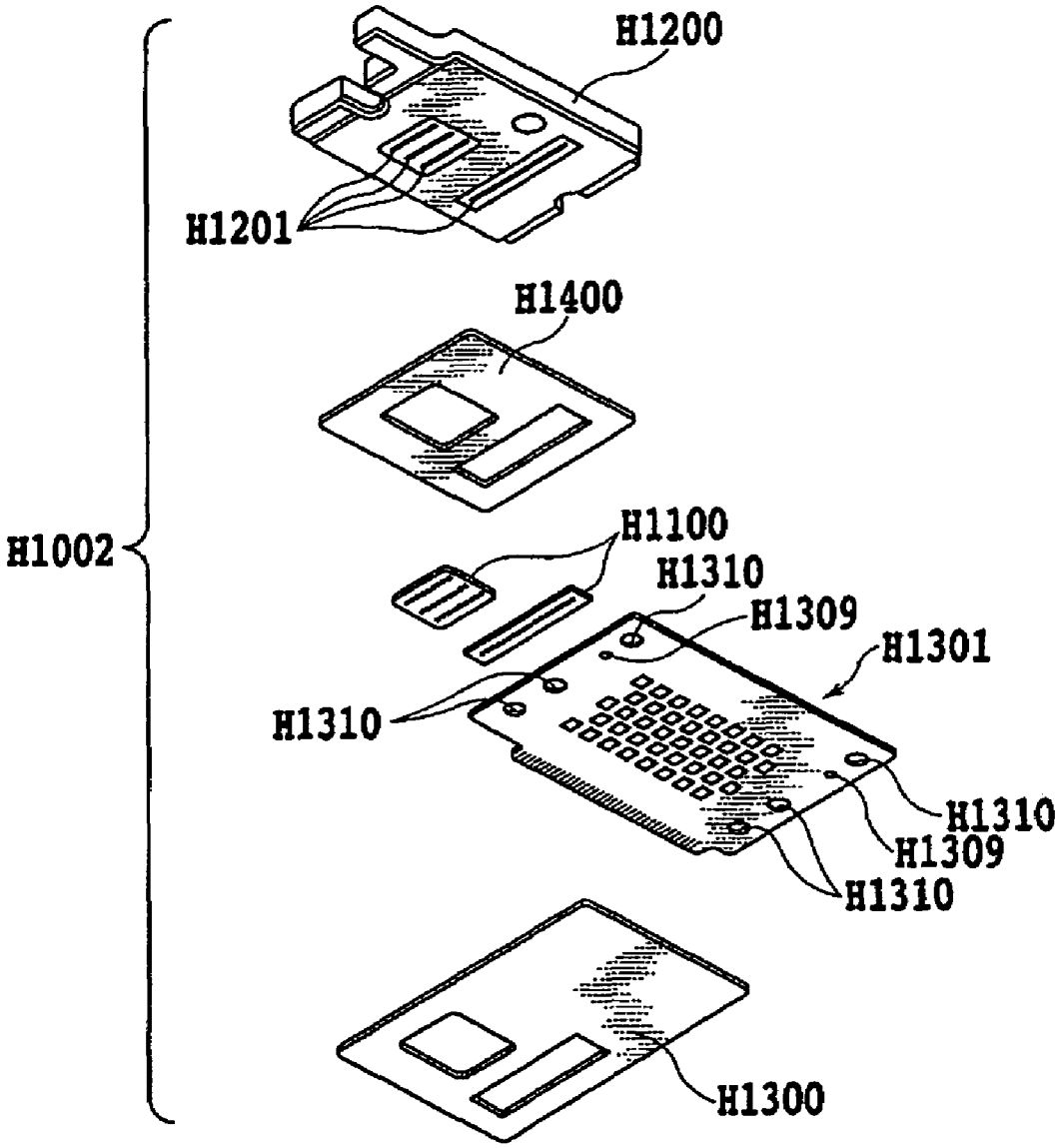
FIG. 5 is an exploded perspective view of a recording element unit, which is a component of the recording head of FIGS. 3A, 3B, and 4.

FIG. 5 is an exploded perspective view of the recording element unit H1002. The recording element unit H1002 includes the following components: recording element substrates H1100, a first plate H1200 which is a first support member, an electric wiring tape H1300 which is a flexible wiring member, an electrical contact board H2200 and a second plate H1400 which serves as a portion for holding the recording element substrates and which is a second support member.

The recording element substrates H1100 are bonded and fixed to the first plate H1200. The second plate H1400 having opening portions is bonded and fixed to the first plate H1200. Further, the electric wiring tape H1300 is bonded and fixed to the second plate H1400 to maintain the position thereof relative to the recording element substrates H1100. The electric wiring tape H1300 applies electric signals for ejecting ink to the recording element substrates H1100. That is, the electric wiring tape H1300 has electric wiring corresponding to the recording element substrates H1100 and is connected to the electrical contact board H2200 having external signal input terminals H1301 which receive electric signals from the body of the inkjet recording apparatus. The electrical contact board H2200 is fixed to the ink supply unit H1003 in a state in which the electrical contact board H2200 is positioned by two terminal-positioning holes H1309.

It should be noted that in the example illustrated in this drawing, a configuration is illustrated which has two recording element substrates H1100, for example, one for black ink and the other for cyan, magenta, and yellow inks. In the former, heating portion arrays are arranged on both sides of an ink supply port for black ink. In the latter, heating portion arrays are arranged on both sides of each of respective ink supply ports for cyan, magenta, and yellow inks. The wiring of the latter substrate will be described as an example below. However, colors of ink used, the number of colors, and the arrangement of heating portions on each recording element substrate are not limited to this example.

Figure 6:
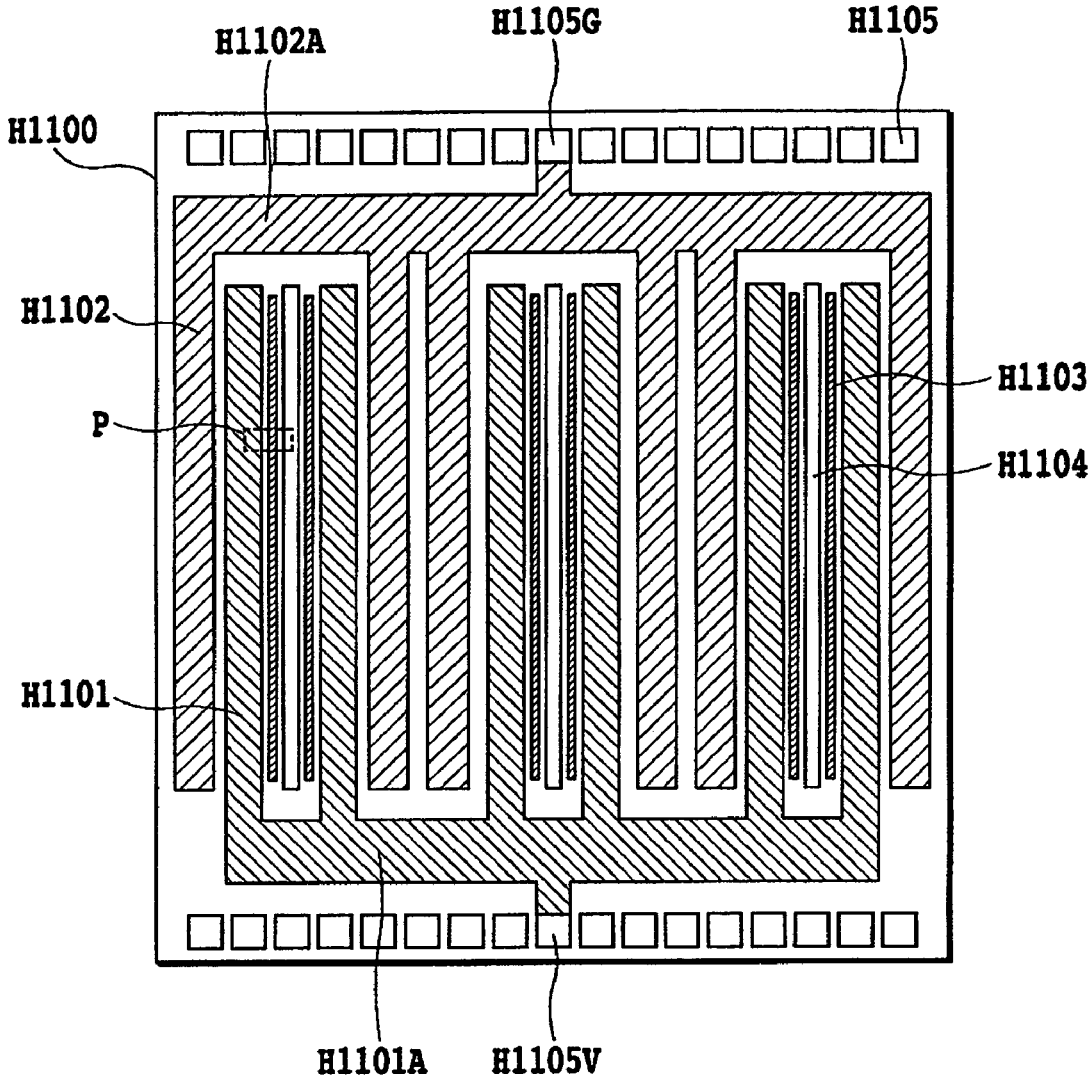
FIG. 6 is a schematic plan view illustrating the configuration of a recording element substrate according to the embodiment of the present invention which is used in the recording element unit of FIG. 5.
Figure 7:
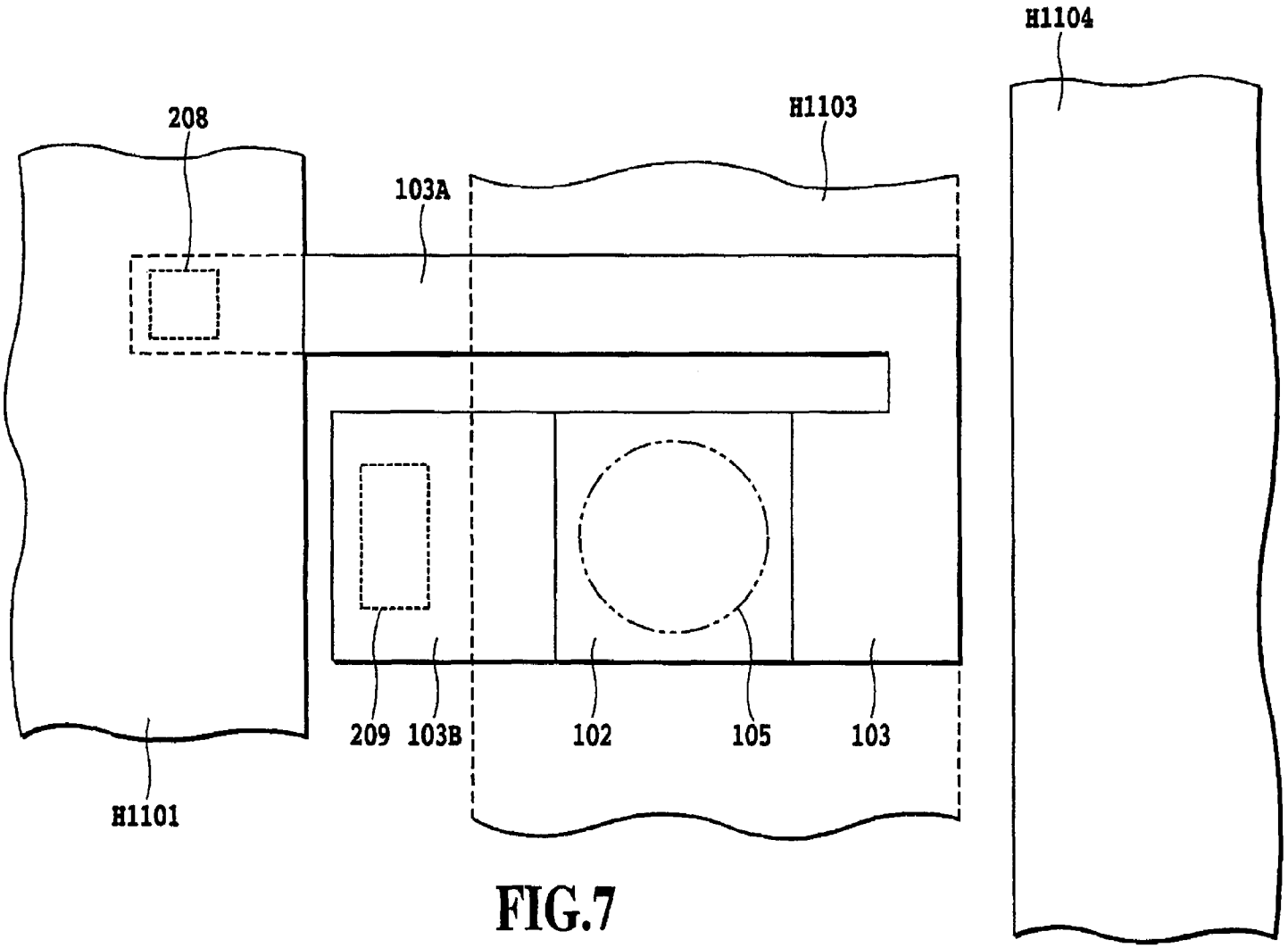
FIG. 7 is a schematic plan view illustrating a magnification of part of FIG. 6.

FIG. 6 is a plan view illustrating the configuration of the recording element substrate H1100, which is an essential portion of this embodiment. FIG. 7 is a plan view illustrating a magnification of portion P around one heating portion of a group of heating portions arranged in the recording element substrate H1100. This recording element substrate H1100 has two heating portion arrays integrated therein for each of three colors of yellow, magenta, and cyan. The wiring on this recording element substrate H1100 will be described as an example below. However, it is a matter of course that the basic wiring structure thereof can be applied to the recording element substrate for black ink.

Figure 1:
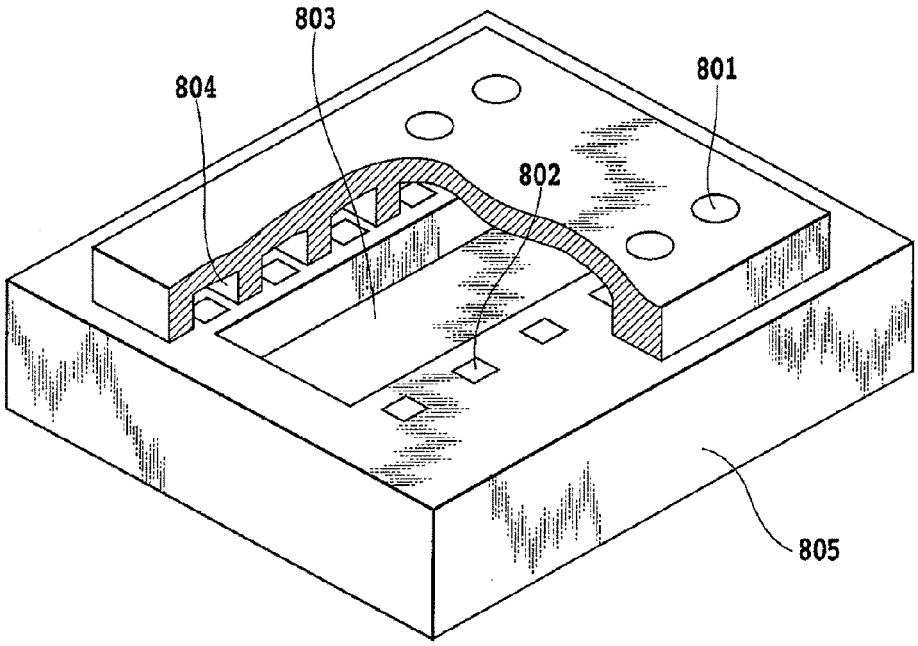
FIG.1 PRIOR ART
FIG. 1 is a schematic perspective view for explaining a general configuration example of an inkjet recording head, in which part of the recording head is cut out.
Figure 2:
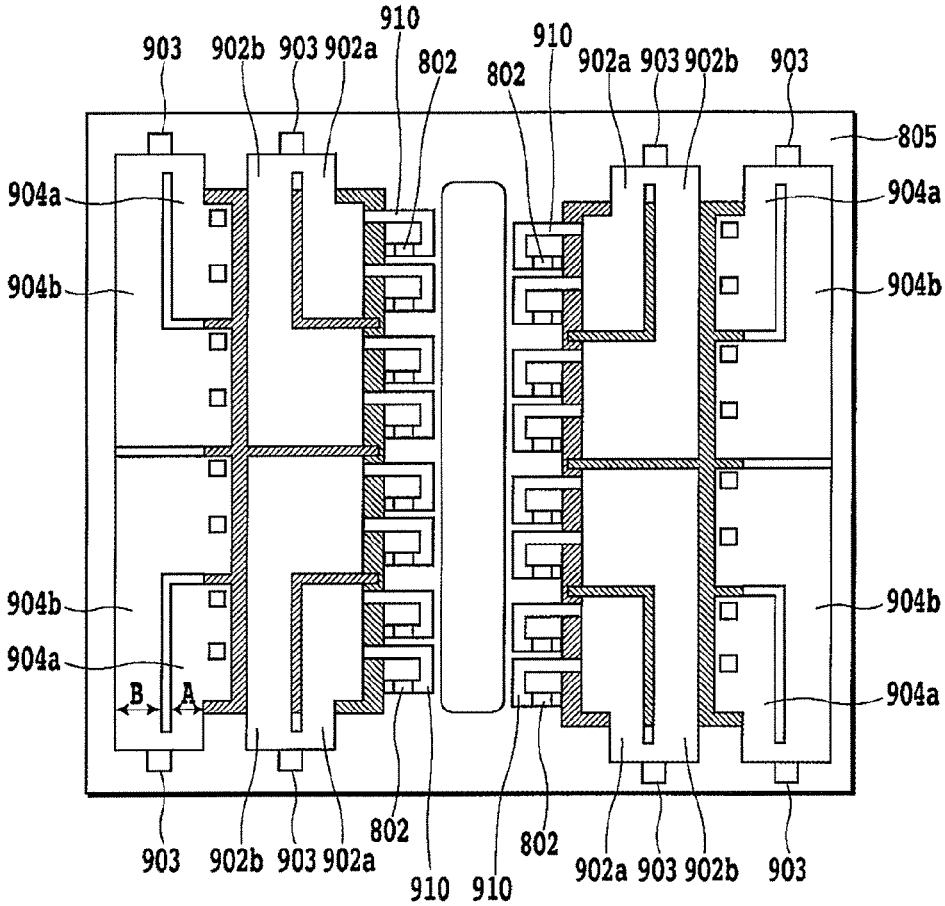
FIG.2 PRIOR ART
FIG. 2 is a schematic plan view for explaining a conventional basic configuration used for the recording head of FIG. 1.

In the recording element substrate H1100, a plurality of arrays H1103 of heating portions 102 which generate thermal energy used to eject ink are provided on one surface of a Si base having a thickness of 0.5 to 1 mm. Further, an ejection opening-forming member (not shown) is placed so that ink ejection openings 105 face the surfaces of these heating portions 102. Similar to the general configuration of FIG. 1, the ejection openings 105 communicate with the ink supply ports H1104 having openings on the surface of the substrate H1110 through ink passages provided in the ejection opening-forming member. The ink supply ports H1104 are shaped like long grooves over a range corresponding to the arrangement of the ejection openings or the heating portions 102, and penetrate the substrate H1110 to also have openings on the backside thereof. The openings on the backside correspond to ink-communicating ports H1201 formed in the first plate H1200 to be supplied with ink.

The heating portions 102 are arranged so that one array is placed on each side of each ink supply port H1104 in a checkerboard or staggered pattern in which the arrangement pitch is shifted by ½ in the vertical direction of this drawing. Such plurality of heating portions 102 can be formed by, for example, the following steps:

Form a resistor layer on a base in which a driving circuit including driving elements made of semiconductor elements, such as switching transistors, for selectively driving the plurality of heating portions 102 has been formed in advance.

Further, deposit an electrode wire layer for forming electrode wires (heater wires) 103 for each heating portion 102.

Then, etch these layers one after the other to perform desired patterning and, further, partially remove the electrode wire layer so that the resistor layer in the relevant regions is exposed.

One end of each heating portion 102 is connected to the corresponding common power supply line H1101 through one portion 103A of the corresponding heater wires 103. The electrode wire 103A may be formed to be continuous with the common power supply line H1101 in the same layer. Alternatively, the electrode wire 103A and the common power supply line H1101 may be formed in different layers as indicated by dashed lines in this drawing to be connected to each other through a through hole 208. The other end of the heating portion 102 is connected through the other 103B of the heater wires 103 and, for example, a through hole 209 to a driving circuit formed in a lower layer and then to a common GND line H1102.

Here, in this embodiment, heating portion arrays H1103 are provided along long sides of each ink supply port H1104, common power supply lines H1101 extend on the outside of the heating portion arrays H1103, and common GND lines H1102 extend on the outside of the common power supply lines H1101. The common power supply lines H1101 and the common GND lines H1102 are collectively wired to wiring portions H1101A and H1102A provided along opposite side portions of the substrate which extend in the direction perpendicular to the heating portion arrays H1103, respectively. Further, each of the wiring portions H1101A and H1102A is connected to one (H1105V or H1105G) of electrode pads H1105 arranged in the opposite side portions.

Thus, all heating portions included in one heating portion array H1103 are substantially equal in the sum of the length of the common power supply line from the electrode pad H1105V to a position immediately near each heating portion and the length of the common GND line from a position immediately near the driving element for the heating portion to the electrode pad H1105G. That is, the combined resistance of common wiring portions can be made substantially equal for all heating portions included in one heating portion array H1103.

The electrodes pads H1105 are provided for the common power supply line H1101 and the common GND line H1102. Other than these, a predetermined number of electrodes pads H1105 are provided in order to supply the driving circuit with driving data for driving the plurality of heating portions for each color in accordance with respective recording data and data for determining driving timing. In this embodiment, the common power supply lines H1101 and the common GND lines H1102 are respectively wired together in the vicinities of the electrode pads to be respectively connected to one pads. This is particularly effective in reducing the number of electrode pads.

Further, bumps (not shown) on the electrode pads H1105 of the recording element substrates H1100 fixed to the first plate H1200 are electrically connected to electrode leads (not shown) of the electric wiring tape H1300 by ultrasonic thermal bonding or the like. This makes it possible to apply electric signals to the recording element substrate H1100 for driving the heating portions to eject ink.

Figure 8:
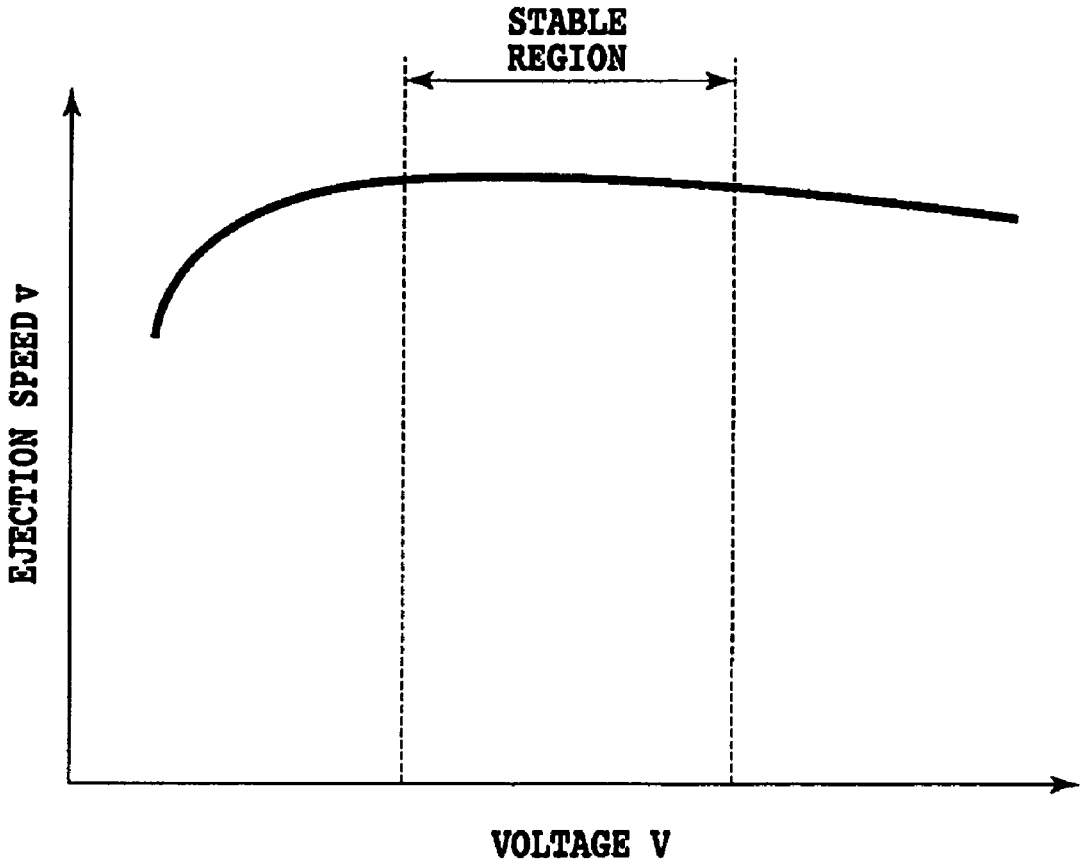
FIG. 8 is a view illustrating a graph indicating the relationship between a voltage applied to a heating portion formed on the substrate and the ejection speed of ink ejected from an ink ejection opening of the recording head.

FIG. 8 is a view illustrating the state of the ejection of ink in terms of the ejection speed v from an ejection opening with respect to a voltage V applied between both ends of a heating portion 102. As apparent from this drawing, the ejection speed or ejection state of ink changes depending on the applied voltage. For this reason, heretofore, a unit of heating portions simultaneously driven has been first decided. Then, a common power supply line and a common GND line have been formed for each unit of heating portions simultaneously driven in a recording element substrate to be respectively extended to the vicinities of electrode pads so that the difference in the voltages applied between both ends of the heating portions included in each unit falls within a range in which stable ejection is performed. A range in which stable ink ejection can be actually performed is the range of the stable region illustrated in FIG. 8 and, in general, a range of +/−5% in terms of the voltage between both ends of the heating portion.

However, heretofore, the sum of the length of a power supply-side common line and that of a GND-side common line has differed depending on the position of the heating portion, and the combined resistance of common wiring portions for each heating portion has differed depending on the position of the heating portion. When consideration is also given to variations in the resistances of the heating portions, the durability of heat elements, and the like, the number of heating portions simultaneously driven has been significantly limited for the purpose of controlling the voltage fluctuation within a range of approximately 5%.

On the other hand, in this embodiment, the combined resistance of common wiring portions can be made substantially equal for all heating portions included in one heating portion array H1103. This makes it possible to greatly relax limitations on the number of heating portions which can be simultaneously driven, i.e., which are wired together to a power supply side and a GND side.

Figure 9:
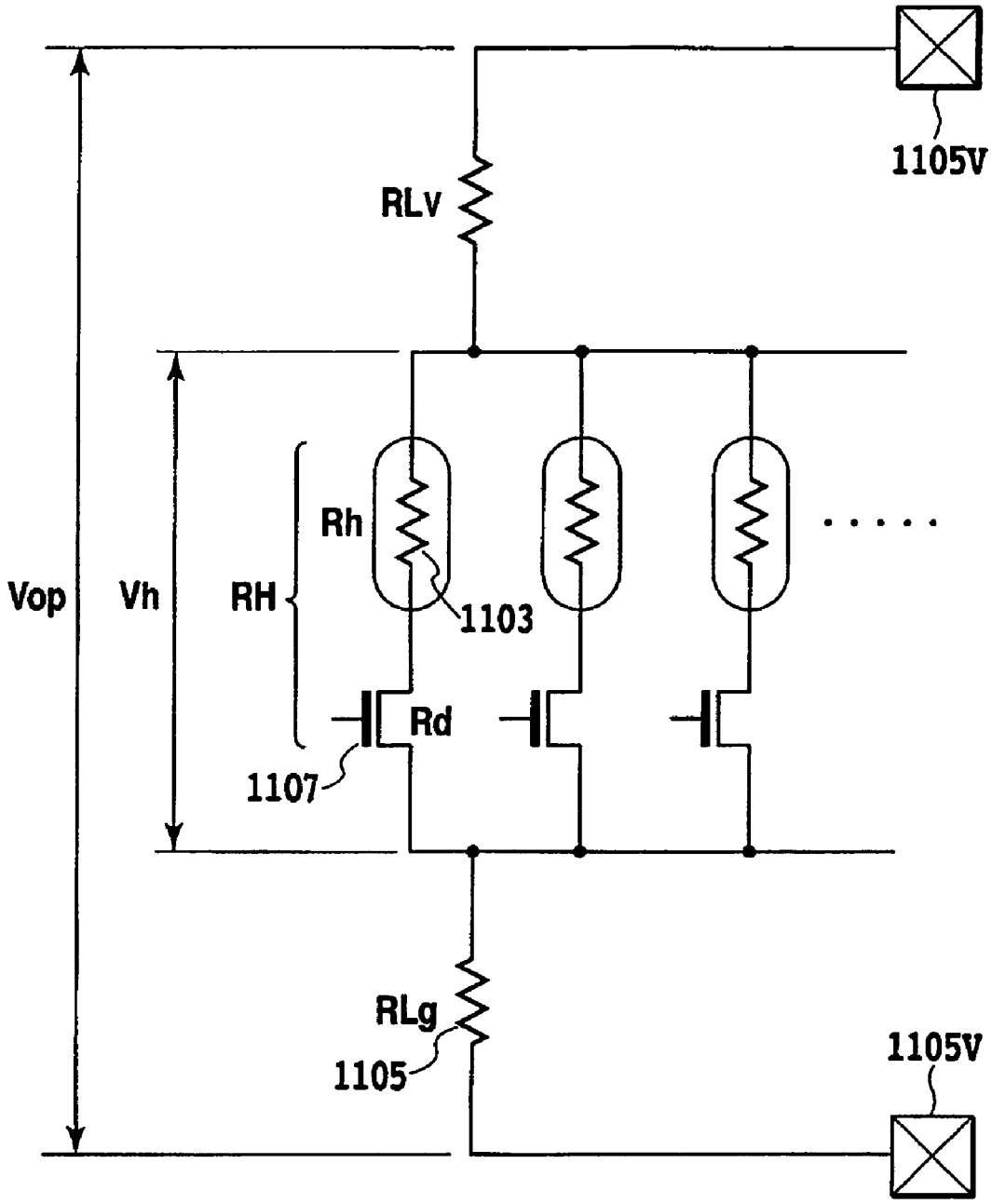
FIG. 9 is an equivalent circuit diagram including interconnections and recording elements on the substrate.

FIG. 9 is an equivalent circuit diagram including a common power supply line and a common GND line (hereinafter also generically called "common lines"), heating portions 102, and driving elements H1107 which are connected to one ends of the heating portions 102 and which perform switching between energized and non-energized states in accordance with the presence or absence of recording data. Here, the sum of the resistances of a heating portion 102 and a driving element H1107 (these are hereinafter referred to as a "recording element" when collectively called) is denoted by RH. In the wiring structure of FIG. 6, RL which is the combined resistance of common wiring portions is the sum of the following two resistances: the resistance RLv of a power supply line from the electrode pad H1105V to a position immediately near the heating portion 102, and the resistance RLg of a GND line from the electrode pad H1105G to a position immediately near the driving element 107 corresponding to the heating portion 102. This is substantially equal for all heating portions which belong to the same array.

Accordingly, in the case where one recording element is driven, the combined resistance of the system is RL+RH. In the case where n recording elements are driven, the combined resistance of the system is RL+RH/n. Therefore, in the case where only one recording element is driven, the voltage applied between both ends of the recording element is as follows:

$$Vh(1)=Vop\times RH/(RL+RH) \quad \text{(Formula 1)}$$

In the case where n recording elements are driven, the voltage applied between both ends of each of the n recording elements is as follows:

$$Vh(n)=Vop\times(RH/n)/(RL+RH/n) \quad \text{(Formula 2)}$$

Here, voltage fluctuation allowable in the substrate is denoted by r, and it is assumed that voltage fluctuation for the case where only one recording element is being driven should be controlled to be less than r. Then, the following holds true:

$$Vop\times RH/(RL+RH)-Vop\times RH/(RL+RH/n)<r\times Vop\times RH/(RL+RH) \quad \text{(Formula 3)}$$

From this formula, the ratio of RL to RH satisfies the following:

$$RL/RH<r/(n-n\times r-1) \quad \text{(Formula 4)}$$

Here, if it is assumed that r=5%, the resistance ratio satisfies the following:

$$RL/RH<0.05/(0.95\times n-1) \quad \text{(Formula 5)}$$

Hereinafter, examples in which numeric values are actually substituted will be described.

For example, it is assumed that eight of 16 recording elements corresponding to a pair of common lines can be simultaneously driven, and that the fluctuation rate is 5%. In this case, RL/RH is found by substituting eight into n of Formula 5. Then, it is required that the ratio of the resistance RL of the common lines to the resistance RH of each recording element is controlled to be not more than 0.0076. Here, if the resistance of the recording element is assumed to be 400 Ω, the resistance of the common lines becomes not more than 3.00 Ω.

The actual resistance of the common lines is determined by the thickness and width of the common wiring portions and the maximum value of the length thereof from the electrode pads to recording elements. For example, in the case where 256 recording elements are provided with a heater pitch of 600 dpi on each side and Al wiring is performed in a width left except for present driving elements and a present logic circuit, the relationship of the aforementioned formula 1 can be satisfied by using a wiring thickness of not less than 0.4 μm. Alternatively, it is assumed that 512 recording elements are provided. To perform driving at the same frequency, 16 recording elements are driven for a pair of common lines. Accordingly, the resistance of the common lines becomes not more than 1.39 Ω, and the thickness of the common lines becomes not less than 1.5 μm.

In this case, the combined resistance of common wiring portions is substantially equal for all heating portions which belong to the same array. Accordingly, the aforementioned resistance requirement can be satisfied for all heating portions which belong to the same array. Further, the aforementioned resistance requirement can be satisfied for heating portions which belong to other heating portion arrays related to the same color and other colors because they have similar configurations. Accordingly, as illustrated in FIG. 6, the number of electrode pads can be set to the smallest value (one) for each of the power supply side and the ground side.

In the above-described embodiment, the common lines provided for all ink supply ports are collectively connected to one electrode pads, respectively. However, actually, in the case where RL changes depending on the distances from the electrode pads H1105 to the heating portions 102 because of tolerances or the like of wiring portions, n satisfying the aforementioned resistance requirement can also be decided to wire each group of n recording elements to an electrode pad. In any case, limitations on the number of heating portions which can be simultaneously driven can be greatly relaxed compared to those for the case of known wiring connection. Accordingly, the number of pads can also be reduced.

Further, as the number of heating portion arrays H1103 implemented increases as in the substrate illustrated in FIG. 6, which corresponds to inks of a plurality of colors, the difference in the distances from the electrode pads to the heating portion arrays increases. As a countermeasure against this, it is also effective to reduce the resistance of common lines to satisfy the aforementioned resistance requirement by increasing the thickness of the common lines (generally aluminum lines), performing wiring using gold, or forming different metal such as gold on the aluminum lines by plating. This makes it possible to simultaneously drive a larger number of heating portions without changing the routing of wiring and to contribute to fast recording. Alternatively, in stead of this,or in addition to this, the resistance of each resistor element may be increased. This reduces the amount of heat generated in portions except for the heating portions. Thus, a higher thermal-efficiency substrate for an inkjet recording head is provided.

Figure 10:
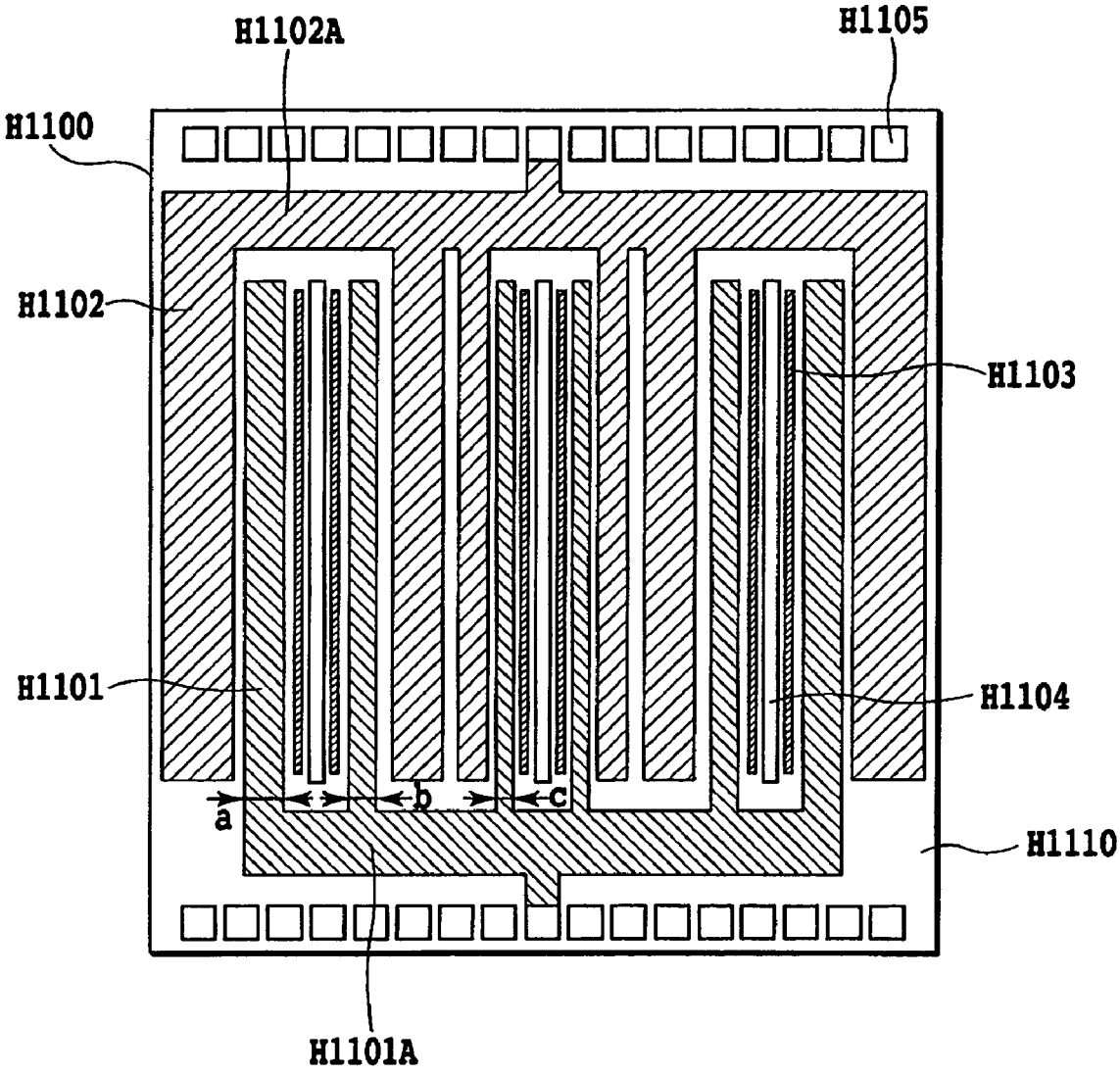
FIG. 10 is a schematic plan view illustrating the configuration of a recording element substrate according to another embodiment of the present invention.

Alternatively, as illustrated in FIG. 10, the resistances of wiring portions can be made equal by giving different widths (a>b>c) to the common lines for the respective heating portion arrays so that the width of a common line for a heating portion array farther from the electrode pads H1105 becomes larger and that the width of a common line for a heating portion array nearer thereto becomes smaller.

Moreover, to cope with variations in energy of the heating portions which are associated with an increase in the number of heating portions simultaneously driven, currents flowing through the heating portions can also be made constant using constant-current elements, thus realizing stable ejection. For example, constant currents can be allowed to flow by the driving elements H1107 being constituted by MOS transistors as illustrated in FIG. 9 and being operated in saturation regions, though the driving elements H1107 can be constituted by various transistors.

Figure 11:
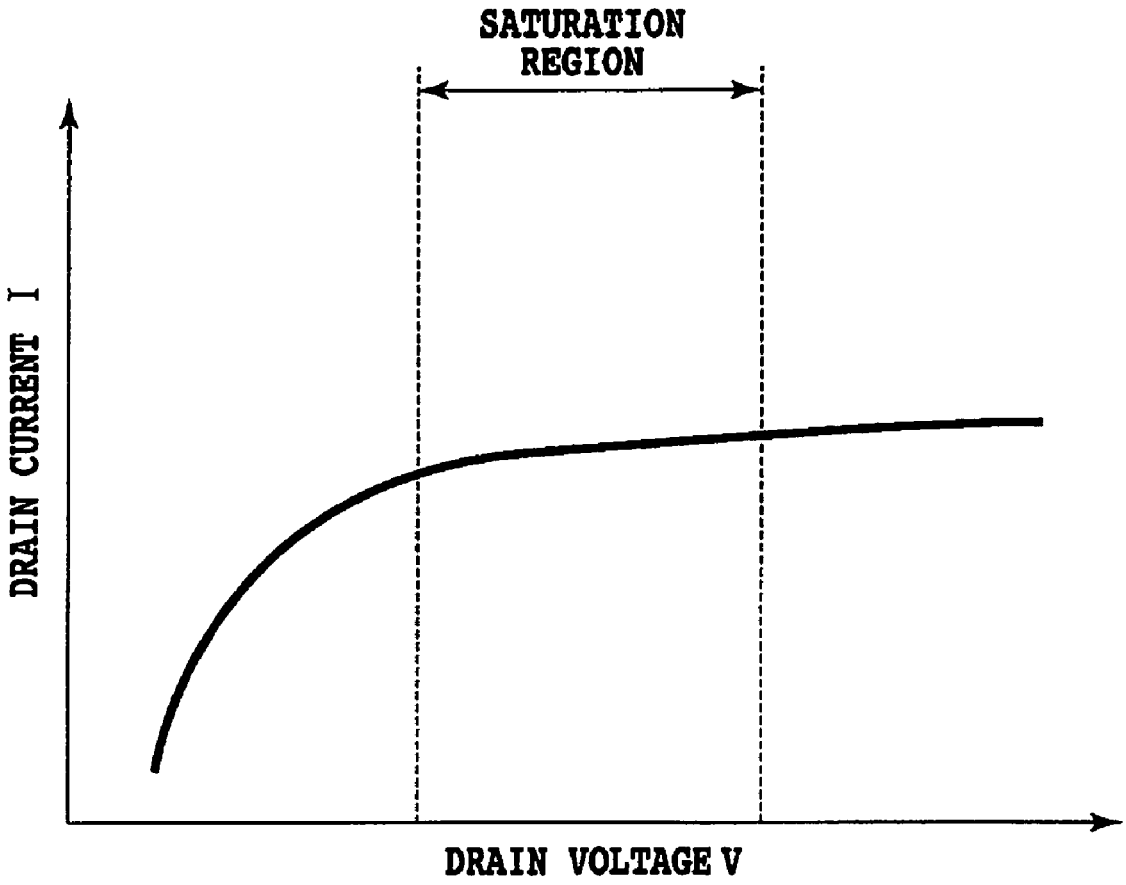
FIG. 11 is a view illustrating a general voltage-current characteristic of a MOS transistor which can be applied as a driving element to a recording element substrate of the present invention.

FIG. 11 illustrates general characteristics of a MOS transistor. For example, if the MOS transistors as the driving elements H1107 are operated in saturation regions, constant currents can be maintained regardless of voltage because of the characteristics. Accordingly, since a constant current always flows through each heating portion 102, the heating portion 102 is supplied with an energy of (the resistance of the heating portion)×(the square of the value of the constant current) without being influenced by the number of heating portions simultaneously driven, unless the resistance changes in use. Thus, variations in energy do not occur. Next, time for energizing a heating portion will be decided so that stable ejection can be performed by supplying approximately constant energy to a substrate or a recording head in which the value of current is set as described above. This can be realized by actually gradually increasing the width of a driving pulse and, when a pulse width at which stable ejection is obtained is obtained, setting the pulse width in a recording apparatus or recording head control means.

Also, in the above-described example, a description has been given of the case where the present invention is applied to an inkjet recording head which ejects ink in a direction perpendicular to the plane of a substrate and to the substrate for the same. However, the present invention does not exclude application to an inkjet recording head which ejects ink in a direction parallel to a substrate and to the substrate for the same, but can also be effectively applied to these.

The present invention has been described in detail with respect to preferred embodiments, and it will now be apparent from the foregoing to those skilled in the art that changes and modifications may be made without departing from the invention in its broader aspect. It is the intention, therefore, in the appended claims to cover all such changes and modifications as fall within the true spirit of the invention.

This application claims priority from Japanese Patent Application No. 2004-363594 filed Dec. 15, 2004, which is hereby incorporated by reference herein.

What is claimed is:

1. A substrate for an inkjet recording head comprising:

a plurality of arrays of recording elements;

a plurality of common power supply wires, each of which extends from a position near one end portion of each array to a position near the other end portion thereof and is connected to a power supply-side electrode pad through the position near the one end portion of the array; and a plurality of common ground wires, each of which extends from a position near to the one end portion of each array to a position near to the other end portion thereof and is connected to a ground-side electrode pad through the position near the other end portion of the array, wherein the plurality of common power supply wires and the plurality of common ground wires are collectively wired to the power supply-side electrode pad and the ground-side electrode pad, respectively, and wherein the plurality of common power supply wires are formed to have different widths depending on distances from the power supply-side electrode pad, and the plurality of common ground wires are formed to have different widths depending on distances from the ground-side electrode pad.

2. The substrate according to claim 1, wherein each recording element includes a heating portion for generating, in response to energization, thermal energy as energy used to eject ink and a driving element for driving the heating portion.

3. The substrate according to claim 2, further comprising means for maintaining currents flowing through the heating portions constant even if a power supply voltage supplied from an outside fluctuates and/or even if an overall current value difference due to changes in the number of recording elements simultaneously driven causes fluctuations in voltage drops of the common power supply wire and the common ground wire.

4. The substrate according to claim 3, wherein the means are the driving elements constituted by MOS transistors, and the currents flowing through the heating portions are maintained constant by controlling the MOS transistors so that the MOS transistors operate in saturation regions thereof.

5. The substrate according to claim 1, wherein the power supply-side electrode pad and the ground-side electrode pad are provided in opposite side portions of the substrate, the opposite side portions facing each other in a direction in which the arrays extend.

6. The substrate according to claim 1, further comprising ink supply ports each of which is shaped like a long groove, the ink supply port penetrating the substrate and having an opening along the array of the recording elements.

7. The substrate according to claim 6, wherein the array of the recording elements, the common power supply wire, and the common ground wire are provided on either side of the opening of the ink supply port.

8. The substrate according to claim 6, wherein the array of the recording elements, the common power supply wire, and the common ground wire are provided to be close to the opening of the ink supply port in the order of mention.

9. The substrate according to claim 6, wherein a plurality of ink supply ports are provided as the at least one ink supply port.

10. The substrate according to claim 1, wherein each common power supply wire and each common ground wire are provided for n recording elements simultaneously driven so that a ratio RL/RH becomes less than $0.05/(0.95\times n-1)$, the ratio RL/RH being obtained by dividing a sum RL of a resistance of the common power supply wire and that of the common ground wire by a resistance RH of the recording element in an energized state.

11. The substrate according to claim 1, wherein the common power supply wires and the common ground wires are formed to be thick films, formed of metal, or plated with gold.

12. An inkjet recording head constructed using the substrate according to claim 1.

13. The inkjet recording head according to claim 12, comprising a member having ejection openings for ejecting ink in a direction perpendicular to a plane of the substrate, the member being bonded to a surface of the substrate on which the recording elements are provided.

14. A substrate for an inkjet recording head comprising:

a plurality of arrays of recording elements;

a plurality of common power supply wires, each of which extends from a position near one end portion of each array to a position near the other end portion thereof and is connected to a power supply-side electrode pad through the position near the one end portion of the array; and a plurality of common ground wires, each of which extends from a position near to the one end portion of each array to a position near to the other end portion thereof and is connected to a ground-side electrode pad through the position near the other end portion of the array, wherein the plurality of common power supply wires and the plurality of common ground wires are collectively wired to the power supply-side electrode pad and the ground-side electrode pad, respectively, and wherein each common power supply wire and each common ground wire are provided for n recording elements simultaneously driven so that a ratio RL/RH becomes less than $0.05/(0.95\times n-1)$, the ratio RL/RH being obtained by dividing a sum RL of a resistance of the common power supply wire and that of the common ground wire by a resistance RH of the recording element in an energized state.

15. The substrate according to claim 14, wherein each recording element includes a heating portion for generating, in response to energization, thermal energy as energy used to eject ink and a driving element for driving the heating portion.

16. The substrate according to claim 15, further comprising means for maintaining currents flowing through the heating portions constant even if a power supply voltage supplied from an outside fluctuates and/or even if an overall current value difference due to changes in the number of recording elements simultaneously driven causes fluctuations in voltage drops of the common power supply wire and the common ground wire.

17. The substrate according to claim 16, wherein the means are the driving elements constituted by MOS transistors, and the currents flowing through the heating portions are maintained constant by controlling the MOS transistors so that the MOS transistors operate in saturation regions thereof.

18. The substrate according to claim 14, wherein the power supply-side electrode pad and the ground-side electrode pad are provided in opposite side portions of the substrate, the opposite side portions facing each other in a direction in which the arrays extend.

19. The substrate according to claim 14, further comprising ink supply ports each of which is shaped like a long groove, the ink supply port penetrating the substrate and having an opening along the array of the recording elements.

20. The substrate according to claim 19, wherein the array of the recording elements, the common power supply wire, and the common ground wire are provided on either side of the opening of the ink supply port.

21. The substrate according to claim 19, wherein the array of the recording elements, the common power supply wire, and the common ground wire are provided to be close to the opening of the ink supply port in the order of mention.

22. The substrate according to claim 19, wherein a plurality of ink supply ports are provided as the at least one ink supply port.

23. The substrate according to claim 14, wherein the common power supply wires and the common ground wires are formed to be thick films, formed of metal, or plated with gold.

24. An inkjet recording head constructed using the substrate according to claim 14.

25. The inkjet recording head according to claim 24, comprising a member having ejection openings for ejecting ink in a direction perpendicular to a plane of the substrate, the member being bonded to a surface of the substrate on which the recording elements are provided.

26. A substrate for an inkjet recording head comprising: a plurality of arrays of recording elements;

a plurality of common power supply wires, each of which extends from a position near one end portion of each array to a position near the other end portion thereof and is connected to a power supply-side electrode pad through the position near the one end portion of the array;

a plurality of common ground wires, each of which extends from a position near to the one end portion of each array to a position near to the other end portion thereof and is connected to a ground-side electrode pad through the position near the other end portion of the array; and means for maintaining currents flowing through heating portions constant even if a power supply voltage supplied from an outside fluctuates and/or even if an overall current value difference due to changes in the number of recording elements simultaneously driven causes fluctuations in voltage drops of the common power supply wire and the common ground wire, wherein the plurality of common power supply wires and the plurality of common ground wires are collectively wired to the power supply-side electrode pad and the ground-side electrode pad, respectively, wherein each recording element includes a heating portion for generating, in response to energization, thermal energy as energy used to eject ink and a driving element for driving the heating portion, and wherein the means are the driving elements constituted by MOS transistors, and the currents flowing through the heating portions are maintained constant by controlling the MOS transistors so that the MOS transistors operate in saturation regions thereof.

27. The substrate according to claim 26, wherein the power supply-side electrode pad and the ground-side electrode pad are provided in opposite side portions of the substrate, the opposite side portions facing each other in a direction in which the arrays extend.

28. The substrate according to claim 26, further comprising ink supply ports each of which is shaped like a long groove, the ink supply port penetrating the substrate and having an opening along the array of the recording elements.

29. The substrate according to claim 28, wherein the array of the recording elements, the common power supply wire, and the common ground wire are provided on either side of the opening of the ink supply port.

30. The substrate according to claim 28, wherein the array of the recording elements, the common power supply wire, and the common ground wire are provided to be close to the opening of the ink supply port in the order of mention.

31. The substrate according to claim 28, wherein a plurality of ink supply ports are provided as the at least one ink supply port.

32. The substrate according to claim 26, wherein the common power supply wires and the common ground wires are formed to be thick films, formed of metal, or plated with gold.

33. An inkjet recording head constructed using the substrate according to claim 26.

34. The inkjet recording head according to claim 33, comprising a member having ejection openings for ejecting ink in a direction perpendicular to a plane of the substrate, the member being bonded to a surface of the substrate on which the recording elements are provided.

* * * * *